US009163508B2

(12) United States Patent
Hudson et al.

(10) Patent No.: US 9,163,508 B2
(45) Date of Patent: Oct. 20, 2015

(54) GEROTOR MOTOR BALANCING PLATE STRUCTURE

(71) Applicant: White Drive Products, Inc., Hopkinsville, KY (US)

(72) Inventors: Terry Hudson, Hopkinsville, KY (US); Jeffrey N. White, Hopkinsville, KY (US)

(73) Assignee: WHITE DRIVE PRODUCTS, INC., Hopkinsville, KY (US)

( * ) Notice: Subject to any disclaimer, the term of this patent is extended or adjusted under 35 U.S.C. 154(b) by 0 days.

(21) Appl. No.: 13/972,415

(22) Filed: Aug. 21, 2013

(65) Prior Publication Data

US 2014/0105775 A1 Apr. 17, 2014

Related U.S. Application Data

(60) Provisional application No. 61/713,148, filed on Oct. 12, 2012, provisional application No. 61/731,503, filed on Nov. 30, 2012.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01C 20/26*** | (2006.01) |
| ***F01C 20/20*** | (2006.01) |
| ***F01C 20/24*** | (2006.01) |
| ***F04C 2/10*** | (2006.01) |
| ***F04C 15/00*** | (2006.01) |
| ***F01C 1/10*** | (2006.01) |

(52) U.S. Cl.

CPC ..... *F01C 20/265* (2013.01); *F01C 1/10* (2013.01); *F01C 20/20* (2013.01); *F01C 20/24* (2013.01); *F04C 2/104* (2013.01); *F04C 2/105* (2013.01); *F04C 15/0042* (2013.01)

(58) Field of Classification Search

USPC ..... 418/61.3, 166, 171, 150, 132, 270

See application file for complete search history.

(56) References Cited

U.S. PATENT DOCUMENTS

| | | | | |
|---|---|---|---|---|
| 4,474,544 | A * | 10/1984 | White, Jr. | 418/61.3 |
| 4,717,320 | A * | 1/1988 | White, Jr. | 418/61.3 |
| 4,877,383 | A | 10/1989 | White | |
| 6,086,345 | A * | 7/2000 | Acharya et al. | 418/61.3 |
| 2004/0052667 | A1 | 3/2004 | Dong | |
| 2006/0263229 | A1 * | 11/2006 | Daigre | 418/61.3 |
| 2009/0317277 | A1 * | 12/2009 | Daigre | 418/61.3 |

FOREIGN PATENT DOCUMENTS

| | | |
|---|---|---|
| EP | 1026400 | 8/2000 |
| WO | 2006/125010 | 11/2006 |

* cited by examiner

*Primary Examiner* — Theresa Trieu

(74) *Attorney, Agent, or Firm* — Rankin, Hill & Clark LLP

(57) ABSTRACT

A gerotor device includes a valving plate, a balancing plate structure, and a rotor positioned between the valving plate and the balancing plate structure. High pressure fluid flowing from the valving plate toward the rotor pushes the rotor toward the balancing plate structure. The balancing plate structure includes a balancing plate and a second plate. A cavity is defined between the balancing plate and the second plate. The balancing plate includes a fluid passage having a check valve and fluid passes through the fluid passage for pressuring the cavity. The balancing plate includes first and second relief holes extending through the balancing plate connected with the cavity.

12 Claims, 4 Drawing Sheets

GEROTOR MOTOR BALANCING PLATE STRUCTURE

BACKGROUND

Gerotor devices operate with a pressure differential between an input port and an output port. A gerotor motor uses this pressure differential to turn a shaft. Because of this pressure differential, a pressure imbalance may occur within the gerotor device. For example, in a gerotor motor having rotor valving, high pressure fluid passing through the rotor forces the rotor away from valving plates, which are adjacent to a forward face of the rotor. This separation reduces the efficiency of the gerotor motor and also increases wear on the rear face of the rotor, which is opposite to the forward face.

U.S. Pat. No. 4,717,320 describes a gerotor motor that overcomes the problems associated with the aforementioned pressure imbalance. A balancing plate structure that biases the rotor back against the valving plates is described. The balancing plate structure includes an annular cavity that is pressurized with hydraulic fluid to bias a balancing plate, which moves the rotor towards the valving plates. When only one relief hole is provided, as described in U.S. Pat. No. 4,717,320, pressure can remain in the annular cavity when the rotor stops and the relief hole is not aligned with a relief groove formed in the rotor. This results in the balancing plate pressing against the rotor in an axial direction. If this pressure is not released, then the balancing plate operates like a brake and impedes rotational and orbital movement of the rotor. When the motor is restarted, the pressure in the fluid pockets defined by the rotor must overcome this "braking" force before the rotor can begin its rotational and orbital movement.

SUMMARY

A gerotor device that can overcome the aforementioned shortcoming includes a valving plate, a balancing plate structure, and a rotor positioned between the valving plate and the balancing plate structure. High pressure fluid flowing from the valving plate toward the rotor pushes the rotor toward the balancing plate structure. The balancing plate structure includes a balancing plate and a second plate. A cavity is defined between the balancing plate and the second plate. The balancing plate includes a fluid passage having a check valve and fluid passes through the fluid passage for pressuring the cavity. The balancing plate includes first and second relief holes extending through the balancing plate connected with the cavity.

DETAILED DESCRIPTION

Figure 1:
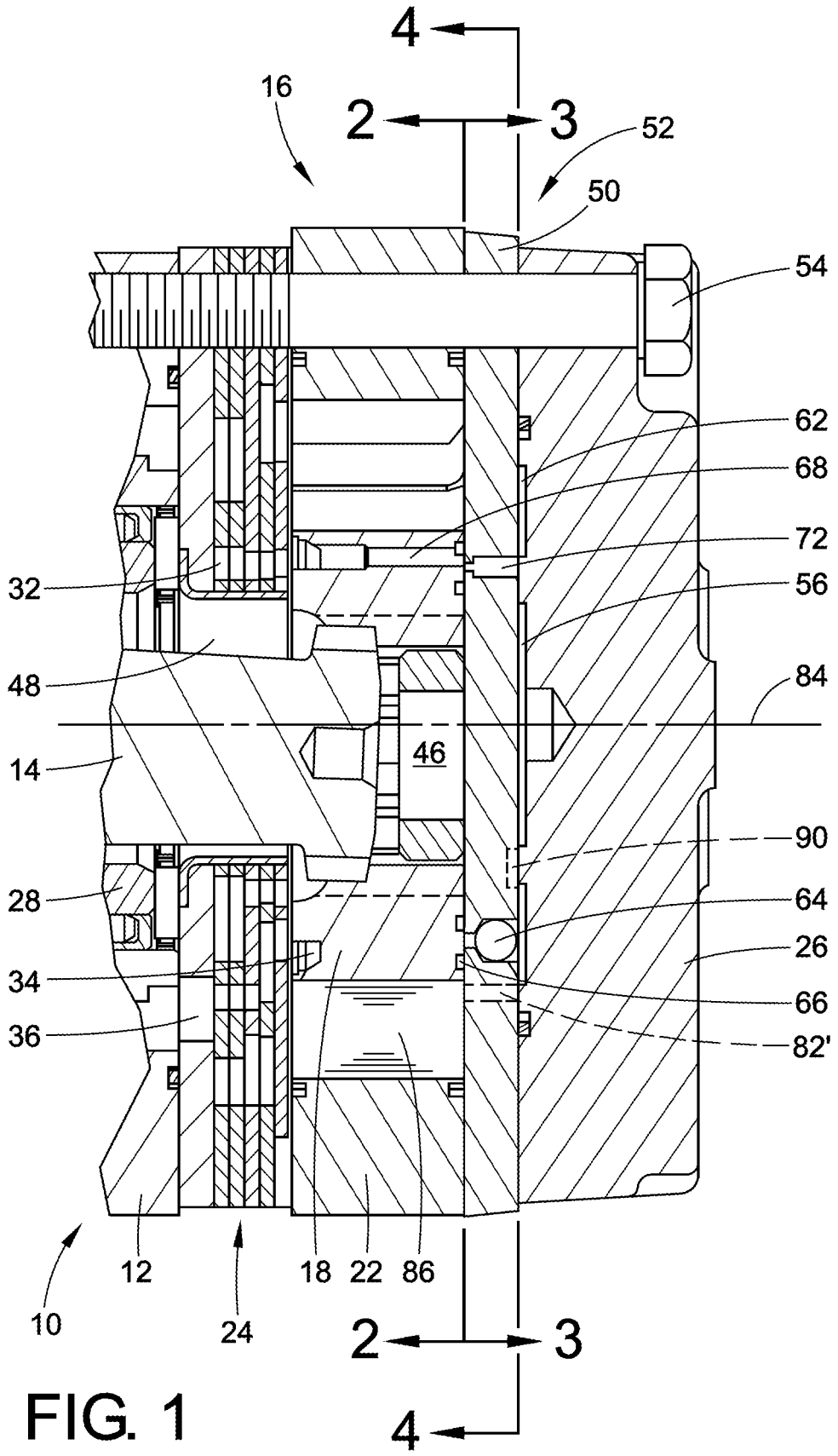
FIG. 1 is a cross-sectional view showing an end section of a gerotor motor having a balancing plate structure.

With reference to FIG. 1, a gerotor motor 10 includes a front housing section 12, a drive link (wobble stick) 14, a gerotor structure 16, which includes a rotor 18 and a stator 22, valving plates 24, an end plate 26 and an output shaft 28.

During operation of the gerotor motor 10, high pressure fluid enters a first port (not shown) and travels through passages within the front housing section 12 toward passages 32 in the valving plates 24. With continued reference to FIG. 1, this fluid travels through the valving plates 24 to a valving groove 34 formed on a forward face of the rotor 18, which faces the valving plates. The valving groove 34 in the rotor 18 communicates with certain bidirectional passages 36 in the valving plates 14, which communicate with expanding fluid pockets 38 (FIG. 2) in the gerotor structure 16. Outgoing fluid travels from contracting fluid pockets 42 (FIG. 2) in the gerotor structure 16 through other of the bidirectional passages 36 in the valving plates 24 to communicate with a center valving opening 46 in the rotor 18. This outgoing fluid then circulates in an opening 48 in the front housing section 12 about the drive link 14 to the second port (not shown) in the front housing section of the motor. For rotation of the output shaft 18 in an opposite direction, the fluid travels in an opposite direction. A complete detailed description of the one-sided rotor valving is set forth in U.S. Pat. No. 4,474,544.

Ordinarily, this rotor valving causes the rotor 18 to tend to be slightly separated from the valving plates 24 and biased toward the end plate 26. The separation of the rotor 18 from the valving plates 24 causes fluid leakage bypassing the gerotor structure 16. This reduces the efficiency of the motor 10. The leakage also produces heat. The biasing of the rotor 18 toward the end plate 26 produces increased friction, which further reduces the efficiency of the motor and increases wear on components of the motor.

A balancing plate 50, which is provided as part of a balancing plate structure 52, counters the effects of the high pressure imbalance on the rotor 18. The balancing plate structure 52 accomplishes this by biasing the rotor 18 back against the valving plates 24 in opposition to the high pressure imbalance otherwise present on the rotor 18. The balancing plate 50 as shown in FIG. 1 is connected to the end plate 26 and the front housing section 12 by main bolts 54. The rotor 18 is positioned between the valving plates 24 and the balancing plate structure 52. The balancing plate structure depicted in FIG. 1 includes the balancing plate 50 and a second plate, which in the depicted embodiment is the end plate 26.

The balancing plate structure 52 includes a first (central) cavity 56 and a first one-way check valve 58 (only shown in FIGS. 3 and 4, similar in configuration to the second one-way check valves 64 described below and shown in FIG. 1) connecting the central cavity 56 to the valving opening 46 in the rotor 18. The balancing plate structure 52 also includes a second (outer annular) cavity 62 that is positioned radially outwardly from and surrounds the central cavity 56. Second one-way check valves 64 connect the second cavity 62 to an outer groove 66 formed on a rear face of the rotor 18. The outer groove 66 is connected to the valving groove 34 on the forward face of the rotor 18 through a passage 68 that extends through the rotor.

The first check valve 58 is positioned in an area swept by the valving opening 46 in the rotor 18. The second check valves 64 are located in positions within the confines of the space swept by the outer groove 66 and not swept by an outer (profile) edge 78 of the rotor 18 (and preferably not swept by a relief groove 74, which is located on the rear face of the rotor 18 radially inward from the outer groove 66).

A first relief hole 72 is located in a position within the confines of the space swept by the relief groove 74 and not swept by either the central valving opening 46 or the outer annular groove 66. It is not necessary for the check valves 58, 64 or the first relief hole 72 to be in constant communication with their respective grooves or openings in the rotor 18. The check valves 58, 64 and the relief hole 72 may only occasionally communicate with their respective grooves or openings to produce the balancing effect. In the device shown, the first check valve 58 is in constant communication with the valving opening 46, one of two second check valves 64 is semi-constant communication with the outer groove 66, and the first relief hole 72 is in intermittent communication with the relief groove 74.

Due to the cooperation between the check valves 58, 64, the balancing plate 50 is biased against the rotor 18. When the valving groove 34 is at relative high pressure, fluid passes through the passage 68 in the rotor 18 and from the outer groove 66 through one of the second check valves 64 to pressurize the outer annular cavity 62 between the balancing plate 50 and the end plate 26. This pressure builds up to bow the balancing plate 50 towards the rotor 18. This bowing of the balancing plate 50 biases the rotor 18 against the valving plates 24 to equalize the axial pressure on the rotor. The pressure leakage between the balancing plate 50 and the end plate 26 will close the first check valve 58 and hold it shut. When the central valving opening 46 is at relative high pressure, fluid passes through the first check valve 58 to pressurize the central cavity 56 between the balancing plate 50 and the end plate 26. The pressure builds up to bow the balancing plate 50 towards the rotor 18. The pressure leakage between the balancing plate 50 and the end plate 26 will close the second check valves 64 and hold them shut.

By communicating with the relief groove 74 in the rear face of the rotor 18, the first relief hole 72 provides a safety against too great a buildup of pressure between the balancing plate 50 and the end plate 26. The exact size and location of the cavities 56, 62 and the thickness of the plates 50, 26 are chosen to provide the appropriate degree of counter-biasing forces on the rotor 18. For example, the central cavity 56 can have a surface area slightly smaller than the area swept by the valving opening 46, the outer annular cavity 62 can have a surface area generally tracking the area swept by the valving groove 34, and the end plate 26 as the reaction plate should be relatively stiff.

Figure 4:
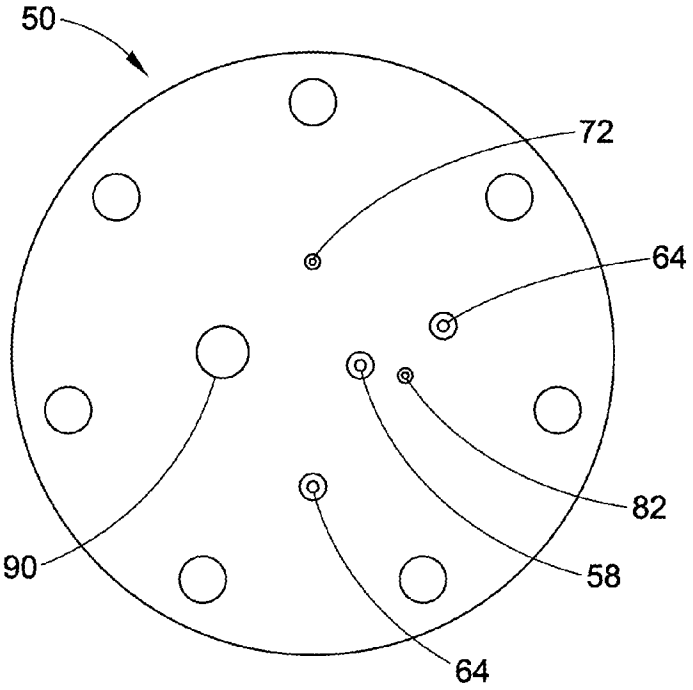
FIG. 4 is a view taken along line 4-4 in FIG. 1.
Figure 3:
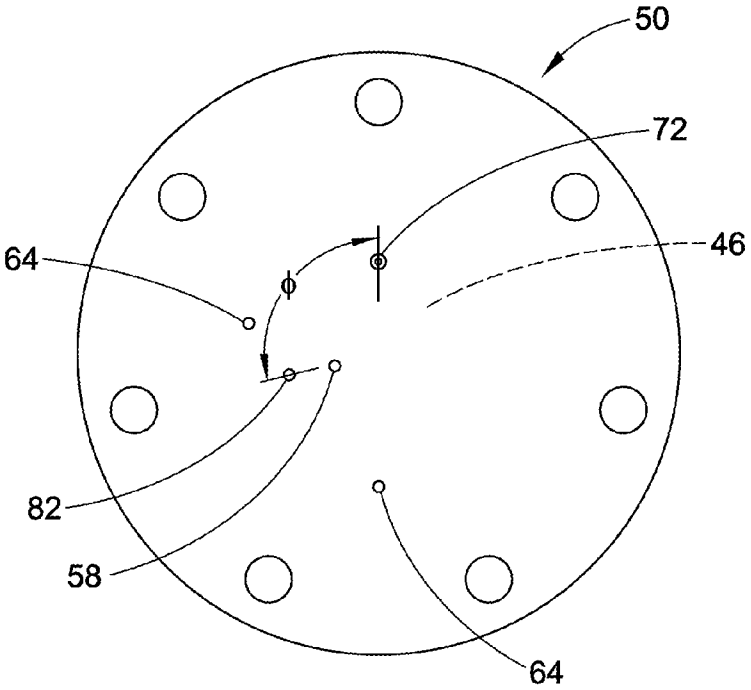
FIG. 3 is a view taken along line 3-3 in FIG. 1.

With reference to FIGS. 3 and 4, a second relief hole 82 extends through the balancing plate 50. The second relief hole 82 is also located in a position such that it is within the confines of the space swept by the relief groove 74 and preferably not swept by either the central valving opening 46 or the outer annular groove 66 as the rotor 18 rotates and orbits within the stator 22. Unlike U.S. Pat. No. 4,717,320 where only a single relief hole is in intermittent communication with a relief groove, the relief holes 72, 82 are located so that at least one of the relief holes 72, 82 is in constant (always in) communication with the relief groove 74. As the rotor 18 orbits within the stator 22, the relief groove 74 moves with respect to a central axis 84 (FIG. 1) of the motor 10. As the relief groove 74 moves to where the first relief hole 72 no longer intersects the relief groove 74, it is at this time that the relief groove 74 now intersects the second relief hole 82.

In the illustrated embodiment and with respect to FIG. 3, the first relief hole 72 is spaced an angle (I) from the second relief hole 82 so that either the first relief hole 72 or the second relief hole 82 is at all times in communication with the relief groove 74 as the rotor 18 rotates and orbits within the stator 22. Since in the illustrated embodiment, the rotor 18 has six lobes and the stator 22 has seven internal teeth (roller 86), the first relief hole 72 is spaced about 102.9 degrees (2/7 of a circle) from the second relief hole 82. This provides the constant communication with the relief groove 74. Where the rotor has n lobes, the first relief hole 72 can be angularly spaced from the second relief hole 82 about 360/(n+1)x degrees, where x is a whole number less than n. In such an instance, x typically equals one or two.

Providing constant communication between at least one of the relief holes 72, 82 and the relief groove 74 provides certain advantages. For example, where only one relief hole is provided, pressure can remain in the outer annular cavity 62 when the rotor 18 stops within the stator 22 and the single relief hole is not aligned with the relief groove 74. This results in the balancing plate 50 pressing against the rotor 18 in an axial direction. If this pressure is not released, then the balancing plate 50 operates like a brake and provides a "braking" force that impedes rotational and orbital movement of the rotor 18. By providing constant (as opposed to intermittent) communication between the outer annular cavity 62 and the relief groove 74 by providing the first and second relief holes 72, 82, the "braking" force does not result no matter the stopping location of the rotor 18 within the stator 22. As such, the rotational and orbital movement of the rotor 18 within the stator 22 can start more quickly upon the start of the motor 10.

The first and second relief holes 72, 82 are smaller than the passages for the check valves 58, 64. In the illustrated embodiment, the first and second relief holes have a larger diameter bore that extends from the rear face of the balancing plate 50 toward the front face, which is in contact with the rotor 18. The diameter of the larger diameter bore for each of the first and second relief holes 72, 82 in the illustrated embodiment is about one-half the diameter of the larger diameter bore that receives the ball in the check valves 58, 64. A smaller diameter bore extends from the forward face of the balancing plate 50 toward the rear face to connect with the larger diameter bore of the first and second relief holes 72, 82. The smaller diameter bore for each of the first and second relief holes 72, 82 is smaller in diameter than the smaller diameter bore for each of the check valves 58, 64.

With reference to FIG. 4, a migration cavity 90 is also provided in the balancing plate 50. The migration cavity 90 connects the central cavity 56 with the outer annular cavity 62 in the balancing plate structure 52 and is schematically depicted in FIG. 1. The migration cavity 90 allows fluid to migrate from the central cavity 56 (FIG. 1) to the outer annular cavity 62 (FIG. 1), and vice versa. Without the migration cavity 90, the central cavity 56 is completely sealed from the outer annular cavity 62, and vice versa. By having the migration cavity 90, the balancing plate 50 reacts quickly and more evenly in both rotational directions as pressure is allowed to work on a larger surface of the balancing plate 50.

Figure 2:
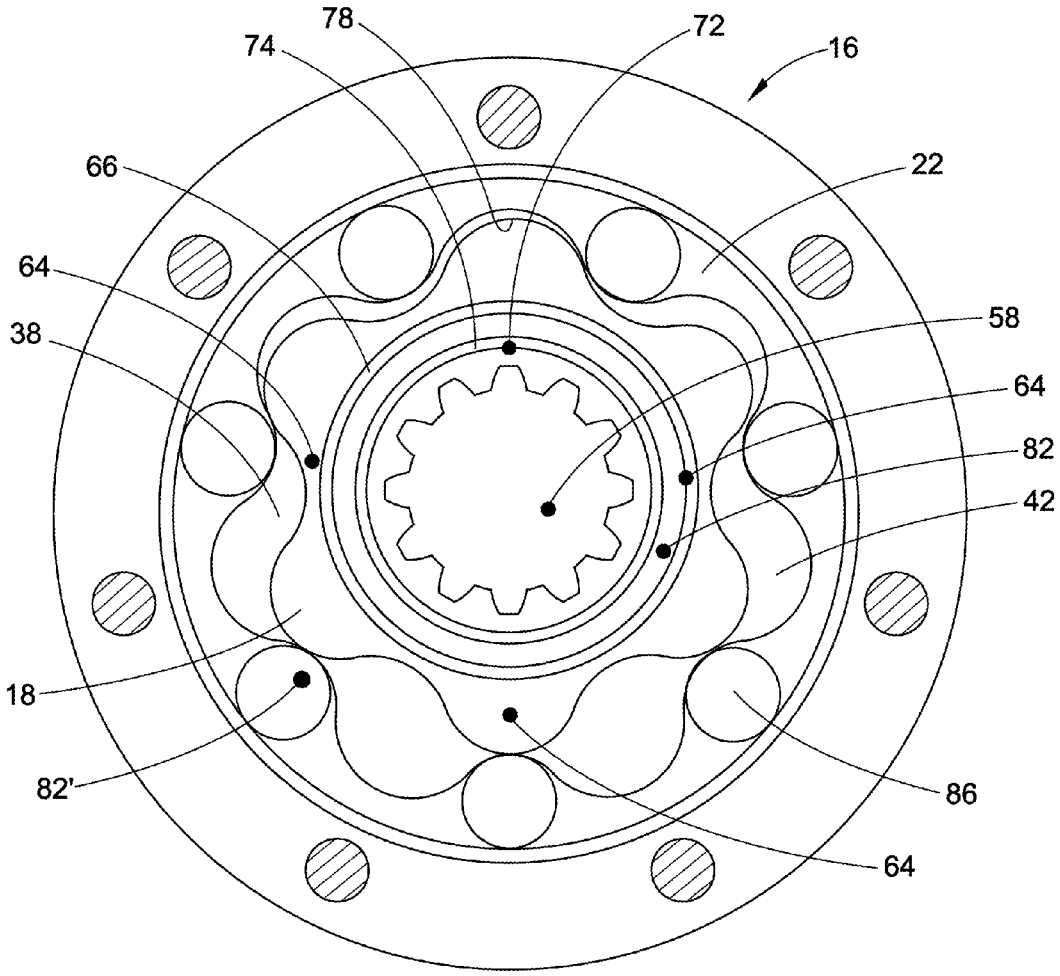
FIG. 2 is a schematic end view of a gerotor section of the gerotor motor shown in FIG. 1 taken along line 2-2 in FIG. 1.

FIG. 2 also depicts an alternative location for a second relief hole 82'. Instead of providing the second relief hole 82 in a position such that it is within the confines of the space swept by the relief groove 74, the second relief hole 82' can be axially aligned with an internal tooth, such as a roller 86, of the stator 22. This second relief hole 82' also extends through the balancing plate 50, however, it is on an opposite side (radially outward) of the second check valve 64, as seen in FIG. 1. Typically, each roller 86 has an axial length that is smaller than the axial length of the stator 22 that receives each roller. This second relief hole 82' can operate as an additional bleed hole to help equalize performance in either rotational direction and create smoother operation when transitioning from low pressure to high pressure by allowing leakage from the outer annular cavity 62 toward a rear planar face of the roller 86 and into the fluid pockets 38, 42. Unlike the first relief hole 72, which is in intermittent communication with the relief groove 74, the second relief hole 82' provides constant communication between the second cavity 62 and the expanding/contracting fluid pockets 38, 42 to provide a controlled leakage path to relieve pressure from behind the balancing plate 50, i.e., the side of the balancing plate opposite the side in contact with the rotor 18. Where the stator 22 does not include rollers as the internal teeth, the second relief hole 82' could radially align with one of the internal teeth of the stator.

Figure 5:
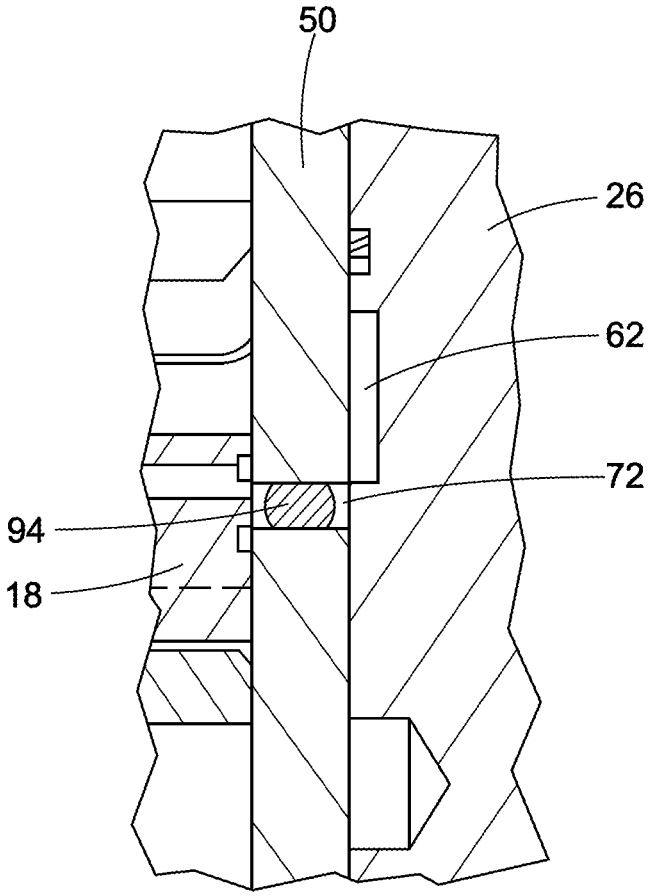
FIG. 5 a cross-sectional view showing an end section of the gerotor motor similar to FIG. 1 where a pellet is positioned within a relief hole.

FIG. 5 depicts a section of the hydraulic motor similar to FIG. 1 in a location adjacent the first relief hole 72. As seen in FIG. 5, a pellet 94 is positioned inside the first relief hole 72. A similar pellet can be received inside the second relief hole 82. In the embodiment that includes the pellet 94, the first and second relief holes 72, 82 need not be smaller than the passages for the check valves 58, 64. The pellet 94 is trapped between the end plate 26 and the rotor 18. Each of the relief holes 72, 82 are positioned in a similar location as that described above. The pellet 94 slides back and forth in each relief hole 72, 82. There is a very small clearance (e.g., about 0.001 inches) between the outer diameter (OD) of the pellet 94 and the inner diameter (ID) of each relief hole 72, 82. As the pellet 94 slides back and forth in each relief hole 72, 82, a quick burst of fluid flow is provided to or from the outer annular cavity 62. After the pellet 94 slides to contact either the rotor 18 or the balancing plate 50, metered flow is provided between the OD of the pellet 94 and the ID of the respective relief holes 72, 82. The pellet 94 will allow a quick release of pressure between the balancing plate 50 and the end plate 26 in the balancing plate structure when the pellet 94 moves since it takes very little volume of hydraulic fluid to activate and deactivate the balancing plate 50.

Although balancing plate structures for gerotor devices have been described with a certain degree with particularity, it is to be understood that numerous changes can be made without departing from the scope of the invention. The invention is defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A gerotor device comprising:

a valving plate;

a balancing plate structure; and a rotor positioned between the valving plate and the balancing plate structure, wherein high pressure fluid flowing from the valving plate toward the rotor between pushes the rotor toward the balancing plate structure, wherein the balancing plate structure includes a balancing plate and a second plate, wherein a cavity is defined between the balancing plate and the second plate;

wherein the balancing plate includes a fluid passage having a check valve and fluid passes through the fluid passage for pressurizing the cavity;

wherein the balancing plate includes first and second relief holes extending through the balancing plate connected with the cavity;

wherein the balancing plate is configured to bow towards and bias against the rotor when the cavity is pressurized;

wherein the rotor has n lobes, and the first relief hole is angularly spaced from the second relief hole about 360/(n+1)x degrees, where x is a whole number less than n.

2. The gerotor device of claim 1, wherein the second plate is an end plate.

3. The gerotor device of claim 1, wherein x equals 1 or 2.

4. The gerotor device of claim 1, wherein the rotor includes a relief groove formed in a rear face of the rotor, wherein at least one of the relief holes is in constant communication with the relief groove as the rotor rotates and orbits in the gerotor device.

5. The gerotor device of claim 1, wherein the rotor includes a relief groove formed in a rear face of the rotor, wherein the first relief hole is located with respect to the second relief hole such that when the rotor moves to where the first relief hole is no longer intersecting the relief groove, the second relief hole is positioned to intersect the relief groove.

6. The gerotor device of claim 1, further comprising a pellet disposed in the relief hole and trapped between the rotor and the second plate.

7. The gerotor device of claim 1, further comprising a stator, wherein the rotor rotates and orbits within the stator, wherein the stator includes a plurality of internal teeth, wherein the second relief hole is aligned with at least one of the internal teeth.

8. The gerotor device of claim 7, wherein the internal teeth are rollers having an axial length less than the stator.

9. The gerotor device of claim 1, wherein the largest diameter of each relief hole is smaller than the largest diameter of the fluid passage having the check valve.

10. A gerotor device comprising:

a valving plate;

a balancing plate structure; and a rotor positioned between the valving plate and the balancing plate structure, wherein high pressure fluid flowing from the valving plate toward the rotor between pushes the rotor toward the balancing plate structure, wherein the balancing plate structure includes a balancing plate and a second plate, wherein a first central cavity is defined between the balancing plate and the second plate;

wherein the balancing plate structure includes a first check valve connecting the first central cavity to a valving opening in the rotor and fluid passes through the first check valve for pressurizing the first central cavity;

a second outer annular cavity is defined between the balancing plate and the second plate and is positioned radially outwardly from and surrounds the first central cavity, wherein the balancing plate structure includes at least two second check valves connecting the second outer annular cavity to an outer groove formed on a rear face of the rotor and connected to a valving groove on the forward face of the rotor through a rotor passage that extends through the rotor, wherein the first check valve is in constant communication with the valving opening and one of the at least two second check valves is in semi-constant communication with the outer groove, wherein due to the cooperation between the first and second check valves, the balancing plate is biased against the rotor, wherein the balancing plate includes first and second relief holes extending through the balancing plate connected with the first and second cavities;

wherein a migration cavity connecting the first central cavity with the second outer annular cavity is provided between the balancing plate and the second plate.

11. A gerotor device comprising:

a valving plate;

a balancing plate structure;

a rotor positioned between the valving plate and the balancing plate structure, wherein high pressure fluid flowing from the valving plate toward the rotor between pushes the rotor toward the balancing plate structure; and a stator, wherein the rotor rotates and orbits within the stator, wherein the stator includes a plurality of internal teeth, wherein the balancing plate structure includes a balancing plate and a second plate, wherein a cavity is defined between the balancing plate and the second plate;

wherein the balancing plate includes a fluid passage having a check valve and fluid passes through the fluid passage for pressurizing the cavity;

wherein the balancing plate includes first and second relief holes extending through the balancing plate connected with the cavity;

wherein the second relief hole is axially aligned with at least one of the internal teeth.

12. The gerotor device of claim 11, wherein the internal teeth are rollers having an axial length less than the stator.

* * * * *